US005527057A

United States Patent [19]

Stritzl et al.

[11] Patent Number: 5,527,057

[45] Date of Patent: Jun. 18, 1996

[54] FRONT JAW

[75] Inventors: Karl Stritzl; Helmut Wladar, both of Vienna; Andreas Janisch, Oeynhausen; Hubert Wuerthner, Hainburg/Donau, all of Austria

[73] Assignee: HTM Sport- und Freizeitgeraete Aktiengesellschaft, Schwechat, Austria

[21] Appl. No.: 278,542

[22] Filed: Jul. 20, 1994

[30] Foreign Application Priority Data

Jul. 21, 1993 [AT] Austria ..... 1443/93

[51] Int. Cl.[6] ..... A63C 9/085

[52] U.S. Cl. ..... 280/629; 280/634

[58] Field of Search ..... 280/625, 628, 280/626, 629, 633, 634

[56] References Cited

U.S. PATENT DOCUMENTS

| | | | |
|---|---|---|---|
| 5,044,657 | 9/1991 | Freisinger et al. | 280/625 |
| 5,149,124 | 9/1992 | Wittmann et al. | 280/625 |
| 5,193,841 | 3/1993 | Stritzl et al. | 280/625 |
| 5,257,798 | 11/1993 | Stritzl et al. | 280/625 |
| 5,273,306 | 12/1993 | Wawra | 280/625 |
| 5,333,891 | 8/1994 | Stritzl et al. | 280/625 |

*Primary Examiner*—Richard M. Camby
*Attorney, Agent, or Firm*—Flynn, Thiel, Boutell & Tanis

[57] ABSTRACT

A front jaw which includes a housing adapted to be fastened to a ski. A release spring is housed in the housing. A spring extends through a pull rod loaded by the release spring. The pull rod acts through a release plate onto the shorter lever arms of two toggle levers pivotally arranged about vertical axes on a bearing part, and the longer lever arms of which are constructed as sole holders for a ski shoe. The bearing part has a through opening for the pull rod and a front facing support surface which rests at least partially on a rear facing crosswall of the housing. The crosswall is contiguous with an approximately horizontally rearwardly extending section, with the front support surface of the bearing part having two sections adjoining one another in elevational direction, the lower section of which defines an obtuse angle (α) with the upper section, with the rear facing crosswall of the housing extending essentially vertically and with a rearwardly and downwardly inclined surface being contiguous with the upper section of the front support surface. The bearing part consists of an upper element and a lower element, which elements are in the assembled state of use connected form-lockingly with one another, with the support surface being provided on the front side of both elements of the bearing part. The two toggle levers are supported on the lower element.

12 Claims, 3 Drawing Sheets

FRONT JAW

FIELD OF THE INVENTION

The invention relates to a front jaw comprising a housing which can be fastened to a ski and in which is housed a release spring and through which extends a pull rod loaded by the release spring, which pull rod acts through a release plate onto the shorter lever arms of two toggle levers which are arranged pivotally about vertical axes on a bearing part, and the longer lever arms of which are constructed as sole holders for a ski shoe, with the bearing part being provided with a through opening for the pull rod and having a front support surface which rests at least partially on a rear facing crosswall of the housing, which crosswall is followed by an approximately horizontally rearwardly extending section, with the front support surface of the bearing part having two sections adjoining one another in elevational direction, the lower section of which defines an obtuse angle ($\alpha$) with its upper section, with the rear facing crosswall of the housing extending essentially vertically, and with a rearwardly and downwardly inclined surface following the upper section of the front support surface.

BACKGROUND OF THE INVENTION

In a front jaw according to AT-B-396 337, the bearing part is designed in one piece and is made of a metal, preferably of a cast aluminum. The use of metal is necessary in order to absorb the forces occurring on the toggle levers or to transfer these through the springy force-transfer mechanism to the housing. If the housing is also made of metal, then an insert plate of plastic is used in order to reduce the frictional forces between the bearing part and the housing. This requires both for the manufacture and also for the installation an additional structural part.

SUMMARY OF THE INVENTION

The goal of the invention is to provide assistance to the design of the bearing part in a front jaw of the above-mentioned type in such a manner that the manufacture of the bearing part is simplified, separate insert plates are not needed and the friction occurring during a use of the front jaw is nevertheless kept low.

Due to the fact that the bearing part consists of two partial elements, with the common support surface being supported on the rear facing crosswall of the housing, and the two toggle levers being supported on the lower partial element, the possibility is created to manufacture the upper partial element only as a casting or jet mold and to design the lower partial element as a stamped metal part. The forces to be transferred by the toggle levers through the bearing part onto the housing are thereby exclusively absorbed by the lower partial element, whereas the upper partial element transfers only the forces occurring during a backward fall or during a backward twisting fall onto the housing. Which materials are to be used in each individual case is left to the judgment of the designer.

A particularly favorable design is achieved since the lower partial element is stamped out of a sheet-metal material and the upper partial element is cast out of plastic. With this the frictional forces can be kept low because the upper partial element manufactured of plastic rests on a metal housing. A further advantage is that the plastic material visible from above can be manufactured right away in the desired color so that an additional coloring process is not necessary.

BRIEF DESCRIPTION OF THE DRAWINGS

Further advantages, characteristics and details of the front jaw of the invention will now be described in greater detail in connection with the drawings.

DETAILED DESCRIPTION

Figure 1:
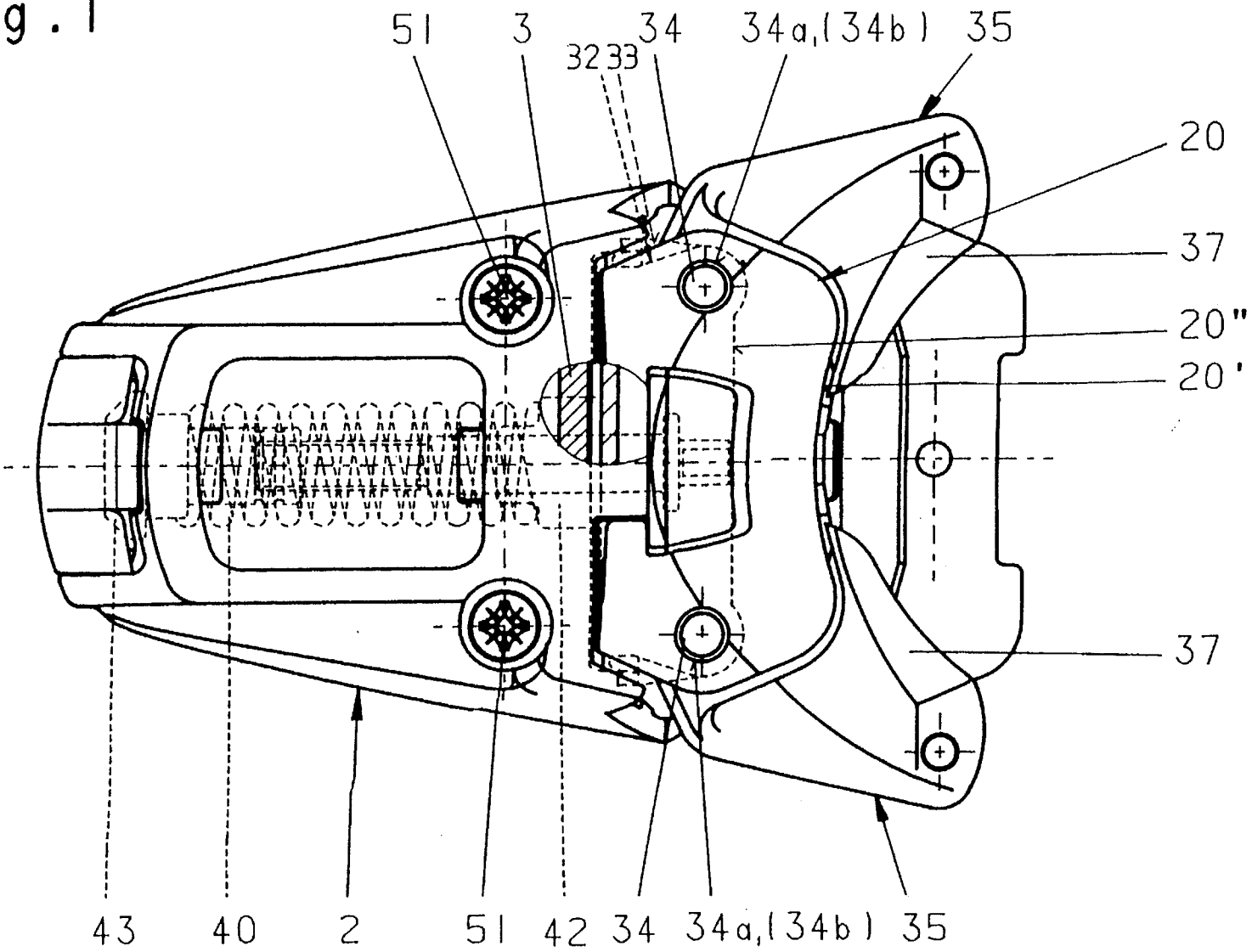
FIG. 1 is thereby a partial elevational top view of the front jaw.
Figure 2:
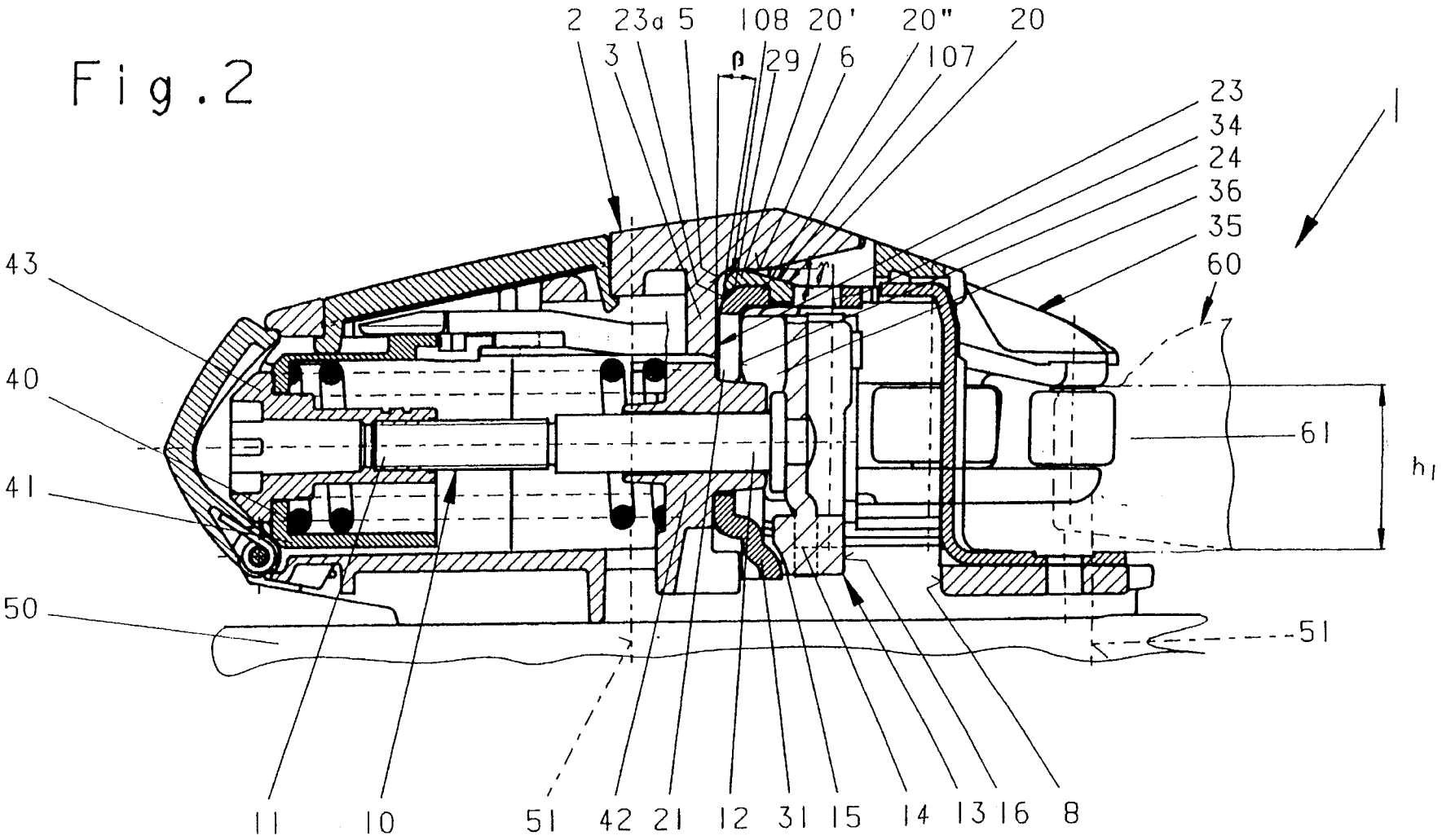
FIG. 2 is a longitudinal cross-sectional view of the front jaw in a position of the ski binding wherein it is ready to be stepped into by a partially indicated ski shoe.

The front jaw 1 of the invention is illustrated in FIGS. 1 and 2 in a position ready to be stepped into. It has a housing 2, which according to FIG. 2 is fastened to a ski 50 by means of screws 51, which are only schematically indicated. A release spring 40 is housed in the housing 2, the initial tension of which release spring can be adjusted in a conventional manner by an adjusting device 43. The release spring 40 is arranged between a spring plate 41 and, with the interpositioning of a bearing sleeve 42, a front facing part of a vertically extending rear facing crosswall 3 of the housing 2. A pull rod 10 extends in axial direction through the release spring 40, one end 11 of the pull rod cooperating with the adjusting device 43 and the other end 12 being connected to an essentially vertically extending release plate 13. The release plate 13 has at its lower end 14 a control surface 15 facing toward the tip of the ski and a stop 16 facing toward the rear end of the ski 50.

A first arched curve 5 is contiguously arranged above the vertically extending rear facing crosswall 3 of the housing 2 and a horizontally rearwardly extending section 6 is contiguously arranged rearwardly of the first arched curve 5. A bearing part 20 is limitedly movably supported by means of its support surface 23 on the rear facing crosswall 33 of the housing 2 in the housing 2. Two toggle levers 35 are pivotally supported on the bearing part 20 by means of two bolts 34 acting as axles.

Figure 3:
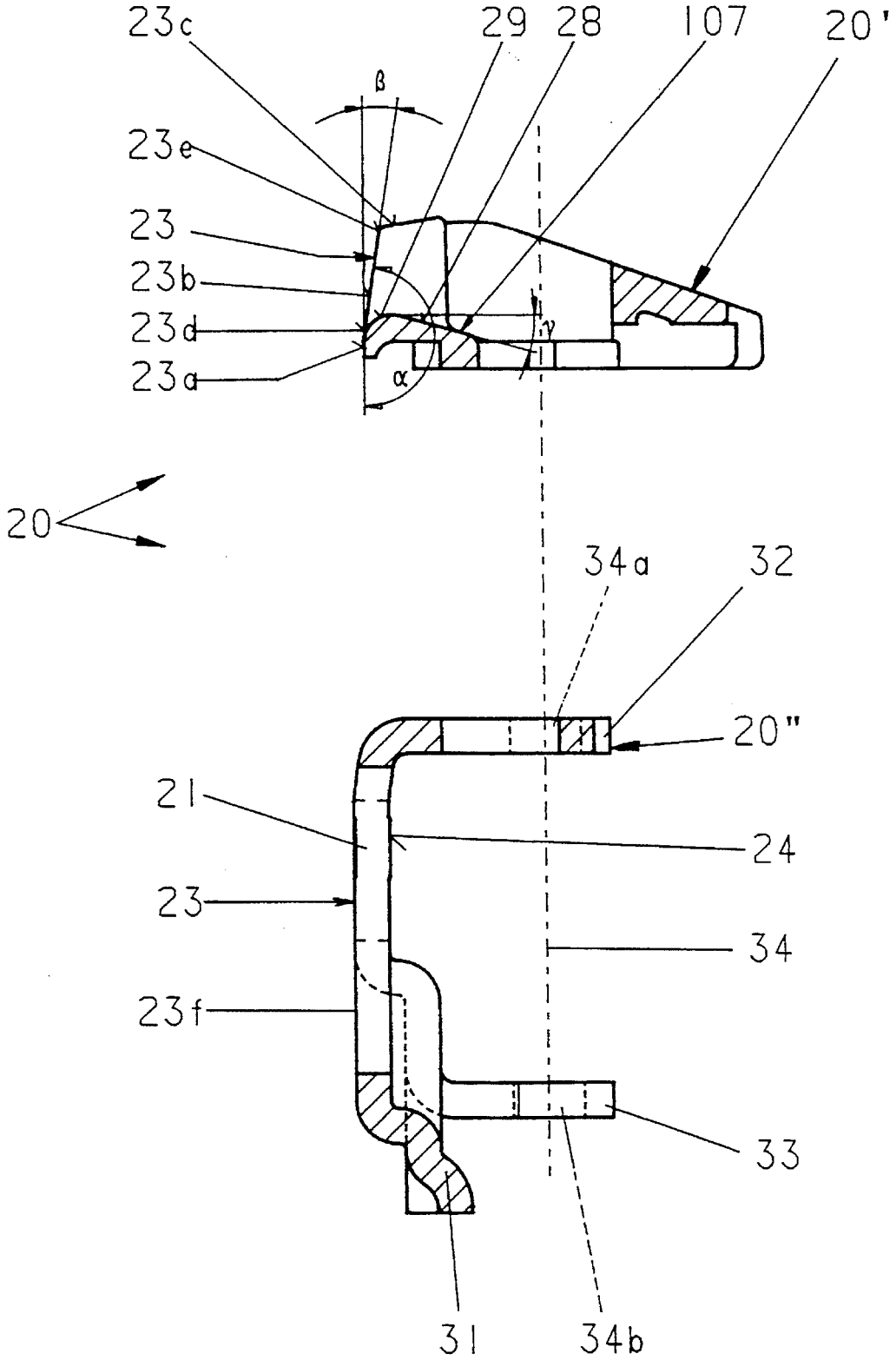
FIG. 3 is a detailed side view of a longitudinal cross-sectional view of the bearing part consisting of two elements.

The bearing part 20 consists, as can be recognized in detail in FIG. 3, of an upper element 20' and a lower element 20", with these two elements 20', 20" being fastened together in the use state by means of the bolts 34 so that a form-locking connection is created. The bolts 34 are, as this can be seen in FIGS. 1 and 3, supported in bores **34*a*, 34*b* which are constructed one above the other in each of two essentially horizontal plates 32, 33 of the lower element 20" of the bearing part 20. The element 20" is for this purpose manufactured of a suitable material, preferably of steel or a die-cast aluminum. The lower element 20" of the bearing part 20 is furthermore, viewed from the rear, annular, namely, it has a through opening 21 for the pull rod 10**.

The support surface 23 of the bearing part 20 is constructed on the front facing side of the upper and of the lower elements 20', 20". The support surface 23 of the upper element 20' has an essentially vertical first section **23*a*, thereabove a slightly rearwardly inclined second section 23*b* and thereabove a further, more strongly rearwardly inclined third section 23*c*. The lower first section 23*a* defines an obtuse angle $\alpha$ with the second section 23*b* lying thereabove. The transition areas between the essentially flat sections 23*a*, 23*b*, 23*c* of the front facing support surface 23 on the upper element 20' are constructed like two fulcrum edges 23***d*, 23*e*, with the lowermost section 23*a* transferring through the first fulcrum edge 23*d* into the second section 23*b* lying thereabove and the second section transferring through the second fulcrum edge 23*e* into the next, third section 23*c* lying thereabove so that during the rolling movement of the bearing part 20 on the crosswall 3 of the housing 2, for example during a rearward release, the fulcrum edges 23*d*, 23*e* form defined support points for the entire bearing part 20. This support point is during a pure rearward release actually a support line, therefore the term "support point" is to be understood hereinafter also as "support line".

The upper element 20' is made of a material which can be easily processed, preferably a plastic, and can already have the color intended for the part visible from above so that a separate coloring is no longer necessary.

The support surface 23 on the lower element 20" is constructed as one single, essentially vertically extending section 23*f*. The first section 23*a* of the upper element 20' is aligned with this section 23*f*, or it is arranged slightly shifted rearwardly for tolerance reasons. It is assured in this manner that without a vertical load on the toggle levers 35, only the lower element 20" rests on the crosswall 3 of the housing 2.

Furthermore, a curved bearing surface 107 is constructed on the upper element 20' of the bearing part 20 on both sides of the longitudinal center plane, by means of which bearing surface the bearing part 20 is supported upwardly on a bearing arm 108, which latter consists of the already described first curve 5 and the horizontally rearwardly extending contiguous section 6. The curved bearing surface 107 is provided in the direct vicinity of the support surface 23 and consists of a further arched curve 29 contiguous with the section 23*a* and a rearwardly and downwardly inclined surface 28 contiguous with the curve 29. The centerpoint of the arched curve 29 lies preferably at the same level with the first (lower) fulcrum edge 23*d* of the support surface 23 so that the action of this fulcrum edge 23*d* is supported as a defined support point. The rearwardly extending and downwardly inclined surface 28 permits an upward pivoting movement of the bearing part 20 until this surface 28 rests on the rearwardly extending, flat section 6 of the bearing arm 108. From this results—in the nonpivoted state of the bearing part 20—the condition that the angle $\beta$, which the second section 23*b* on the upper element 20' defines with the vertical, is smaller than the angle $\gamma$, which the surface 28 of the bearing surface 107 defines with the horizontal, so that the second (upper) fulcrum edge 23*e* is active as a further defined support point.

The toggle levers 35 of this front jaw 1 are designed with two arms in a conventional manner. The shorter lever arms 36 of the two toggle levers 35 are supported on the one side on the release plate 13 and on the other side on a rear support surface 24 of the lower element 20" of the bearing part 20. The longer lever arms of the toggle levers 35 are constructed as sole holders 37 for contact with the sole 61 of a ski shoe 60, which is only schematically indicated in the drawings, which sole holders 37 also hold the ski shoe 60 down.

The lower element 20" of the bearing part 20 carries in its lower section a lever extension 31, with which is associated the control surface 15 on the release plate 13. A path-defining means 8 is furthermore arranged on the housing 2, which path-defining means 8 faces the stop 16 on the release plate 13.

If one inserts the ski shoe 60 into the ski binding, the sole 61 of the ski shoe has an average thickness $h_1$, then the vertical section 23*f* and, if necessary the first section 23*a* of the front support surface 23 rests flatly in the assembled state of the upper and of the lower elements 20', 20" of the bearing part 20 on the rear crosswall 3 of the housing 2, and the bearing part 20 contacts with its arched curve 29 the horizontally upwardly extending section 6 of the housing 2.

If the sole 61 of the ski shoe 60 has a greater, here not illustrated, thickness, then the bearing part 20 tilts easily counterclockwise about the fulcrum edge 23*d*. The release spring 40 is thereby slightly compressed. After the removal of the ski shoe 60, the bearing part 20 with the toggle levers 35 returns automatically into the initial position and it is possible without any manipulation to use selectively ski shoes with a thicker or a thinner sole.

In the case of an upwardly directed increased force, for example during a rearward fall or rearward twisting fall, the bearing part 20 is pivoted against the force of the release spring 40 further about the fulcrum edge 23*d*. The release plate 13 is thereby lifted off from the shorter lever arms 36 of the toggle levers 35, thus enabling for the lateral release a forceless pivoting of the toggle levers 35.

If the upwardly directed force is further increased, the bearing part 20 pivots about the first fulcrum edge 23*d* of the upper element 20' on the crosswall 3 of the housing 2 until it will rest with the rearwardly inclined section 23*b* on the crosswall 3 of the housing 2.

During a yet further increase of the vertical force acting onto the sole holders 37 of the two toggle levers 35, the bearing part 20 continues to pivot about the second fulcrum edge 23*e* of the upper element 20' and is supported in this phase only with the fulcrum edge 23*e* on the crosswall 3 of the housing 2. The stop 16 of the release plate 13 contacts thereby the path-defining means 8 and prevents the toggle levers 35 from swinging out too far.

The embodiments of the invention in which an exclusive property or privilege is claimed are defined as follows:

1. In a front jaw, comprising a housing adapted to be fastened to a ski, and in which a release spring is housed and through which extends a pull rod loaded by said release spring, said pull rod operatively engaging through a release plate a set of shorter lever arms of two toggle levers pivotally arranged about vertical axes on a bearing part, a set of longer lever arms of said two toggle levers being constructed as a sole holder for a ski shoe, said bearing part having a through opening for said pull rod and having a front facing support surface engaging at least partially on a rear facing crosswall of said housing, said housing having a generally horizontally rearwardly extending section that is contiguous with said crosswall, said front support surface of said bearing part having an upper and a lower section thereon, adjoining one another in an elevational direction, said lower section defining an obtuse angle with said upper section, said rear facing crosswall of said housing extending generally vertically, and having a first rearwardly and downwardly inclined surface that is contiguous with said upper section of said front support surface, the improvement wherein said bearing part consists of a separate upper element, a separate lower element, and an engagement means for formlocking said upper element to said lower element into an assembled state, wherein said front support surface is provided on a front side of both said elements of said bearing part with said upper section of said front support surface being provided on said upper element and said lower section of said front support surface being provided on said lower element, and wherein said two toggle levers are supported on said lower element.

2. The front jaw according to claim 1, wherein said lower element is stamped out of a metal, wherein said upper element is cast out of a plastic material, and wherein said upper and lower elements are connected with one another by bolts pivotally supporting said two toggle levers.

3. The front jaw according to claim 1, wherein said front support surface of said bearing part on said lower element includes said lower section which extends vertically, and wherein said front support surface of said bearing part on said upper element includes in succession said upper section having a vertically extending first area, then a lower fulcrum edge following said vertically extending first area, a rearwardly inclined area following said lower fulcrum edge, an upper fulcrum edge following said rearwardly inclined area, and a rearwardly extending area following said upper fulcrum edge.

4. The front jaw according to claim 3, wherein said upper element on both sides of a longitudinal center plane includes a curve following said vertically extending first area and a rearwardly and downwardly inclined bearing surface following said curve.

5. The front jaw according to claim 4, wherein said rearwardly inclined area and a theoretical vertical line define a first angle in said bearing part, and wherein said rearwardly and downwardly inclined bearing surface and a theoretical horizontal line define a second angle, wherein said second angle is larger than said first angle.

6. The front jaw according to claim 3, wherein said bearing part rests only with said lower section of said lower element on said crosswall of said housing when said sole holders are free from a vertically applied force.

7. The front jaw according to claim 3, wherein said bearing part rests with said fulcrum edge of said upper element on said crosswall of said housing when said sole holder receives a vertically applied force.

8. The front jaw according to claim 3, wherein said bearing part rolls through fulcrum edge of said upper element on said crosswall of said housing and comes to rest with said rearwardly inclined area of said upper element on said crosswall of said housing in response to said sole holder receiving an increased vertically applied force during a backward or twisting fall.

9. The front jaw according to claim 8, wherein said bearing part is pivoted further said upper about fulcrum edge of said upper element and is in this phase supported only by said upper fulcrum edge on said crosswall of said housing in response to said sole holder receiving a further increased vertically applied force during a backward or twisting fall.

10. The front jaw according to claim 1, wherein said front support surface of said bearing part on said lower element includes said lower section which extends vertically.

11. The front jaw according to claim 1, wherein said front support surface of said bearing part on said upper element includes in succession said upper section having a vertically extending first area, then a lower fulcrum edge following said vertically extending first area, a rearwardly inclined area following said lower fulcrum edge, an upper fulcrum edge following said rearward inclined area, and a rearwardly extending area following said upper fulcrum edge.

12. The front jaw according to claim 3, wherein prior to movement of said bearing part to operate said release spring, said lower section aligns vertically with said vertically extending first area of said upper section.

* * * * *

UNITED STATES PATENT AND TRADEMARK OFFICE

CERTIFICATE OF CORRECTION

PATENT NO. : 5 527 057

DATED : June 18, 1996

INVENTOR(S) : Karl STRITZL, et al

It is certified that error appears in the above-indentified patent and that said Letters Patent is hereby corrected as shown below:

Column 5, line 31; after "said" (first occurrence) insert ---lower---.

Column 6, line 4; after "through" insert ---said lower---.

Column 6, line 11; delete "about".

line 11; after "further" insert ---about---.

Signed and Sealed this

Fourth Day of March, 1997

*Attest:*

Bruce Lehman

BRUCE LEHMAN

*Attesting Officer*

*Commissioner of Patents and Trademarks*